US011109729B2

(12) United States Patent
Juettner et al.

(10) Patent No.: US 11,109,729 B2
(45) Date of Patent: Sep. 7, 2021

(54) FLOOR TREATMENT SYSTEM

(71) Applicant: ALFRED KARCHER SE & CO. KG, Winnenden (DE)

(72) Inventors: Steffen Juettner, Pliezhausen (DE); Patrick Prasser, Essen (DE); Heiko Blumhardt, Remseck (DE); Barbara Pfister, Weissach im Tal (DE); Christoph Waller, Schwaikheim (DE); Frank Nonnenmann, Schorndorf (DE)

(73) Assignee: ALFRED KÄRCHER SE & CO. KG, Winnenden (DE)

( * ) Notice: Subject to any disclaimer, the term of this patent is extended or adjusted under 35 U.S.C. 154(b) by 372 days.

(21) Appl. No.: 16/178,836

(22) Filed: Nov. 2, 2018

(65) Prior Publication Data

US 2019/0069745 A1 Mar. 7, 2019

Related U.S. Application Data

(63) Continuation of application No. PCT/EP2016/060060, filed on May 4, 2016.

(51) Int. Cl.
*A47L 11/40* (2006.01)
*A47L 11/24* (2006.01)
(Continued)

(52) U.S. Cl.
CPC ..... *A47L 11/145* (2013.01); *A47L 11/302* (2013.01); *A47L 11/4019* (2013.01);
(Continued)

(58) Field of Classification Search
CPC ..... A47L 11/40; A47L 11/34; A47L 11/4019; A47L 9/28
See application file for complete search history.

(56) References Cited

U.S. PATENT DOCUMENTS 5,572,759 A 11/1996 Zachhuber
5,959,423 A 9/1999 Nakanishi et al.
(Continued)

FOREIGN PATENT DOCUMENTS

CN 1551740 12/2004
CN 1665438 9/2005
(Continued)

OTHER PUBLICATIONS

Official Action (with English translation) for Chinese Patent Application No, 201680084638.5, dated Jun. 30, 2020, 10 pages.
(Continued)

*Primary Examiner* — Michael D Jennings
(74) *Attorney, Agent, or Firm* — Sheridan Ross P.C.

(57) ABSTRACT

The invention relates to a floor treatment system, comprising a mobile floor treatment apparatus and a docking station therefor, wherein the floor treatment apparatus has at least one liquid container with a container wall and a container interior, as well as at least one liquid conduit for providing a liquid for the container interior; wherein the docking station comprises a supply conduit which, in a docked position of the floor treatment apparatus on the docking station, is in fluidic connection with the at least one liquid conduit; wherein the floor treatment system comprises an opening device by way of which a wall portion of the container wall is movable, for clearing at least one container opening of the at least one liquid container, into an open position, and in the docked position of the floor treatment apparatus the liquid can exit from the container interior through the container opening.

32 Claims, 5 Drawing Sheets

(51) Int. Cl.
*A47L 11/14* (2006.01)
*A47L 11/30* (2006.01)

(52) U.S. Cl.
CPC ..... *A47L 11/4025* (2013.01); *A47L 11/4083* (2013.01); *A47L 2201/02* (2013.01); *A47L 2201/024* (2013.01); *A47L 2201/026* (2013.01)

(56) References Cited

U.S. PATENT DOCUMENTS

| | | | |
|---|---|---|---|
| 7,891,387 | B2 | 2/2011 | Lim et al. |
| 8,776,305 | B2 | 7/2014 | Troff et al. |
| 9,687,131 | B2 | 6/2017 | Eidmohammadi et al. |
| 2018/0192834 | A1* | 7/2018 | Isenberg ..... A47L 9/2805 |

FOREIGN PATENT DOCUMENTS

| | | |
|---|---|---|
| CN | 101057767 | 10/2007 |
| CN | 101254080 | 9/2008 |
| CN | 201572039 | 9/2010 |
| CN | 102357480 | 2/2012 |
| CN | 103200852 | 7/2013 |
| CN | 104010485 | 8/2014 |
| CN | 204860064 | 12/2015 |
| CN | 106470584 | 3/2017 |
| DE | 4230197 | 3/1994 |
| DE | 102005045669 | 3/2007 |
| DE | 102010038422 | 1/2012 |
| DE | 102014105460 | 10/2015 |
| EP | 1762165 | 3/2007 |
| EP | 2648307 | 10/2013 |
| KR | 10-2014-0036653 | 5/2014 |
| WO | WO 94/05197 | 3/1994 |
| WO | WO 2005/104921 | 11/2005 |
| WO | WO 2015/082017 | 6/2015 |

OTHER PUBLICATIONS

Official Action (with English translation) for Chinese Patent Application No. 201680084615.4, dated Jun. 3, 2020. 15 pages.
Official Action (with English translation) for Chinese Patent Application No. 201780023750.2, dated Jun. 4, 2020, 23 pages.
Translated International Preliminary Report on Patentability for International (PCT) Patent Application No. PCT/EP2016/060060, dated Nov. 15, 2018, 9 pages.
Translated International Preliminary Report on Patentability for International (PCT) Patent Application No. PCT/EP2017/059347, dated Nov. 15, 2018, 8 pages.
Translated International Preliminary Report on Patentability for International (PCT) Patent Application No. PCT/EP2016/060077, dated Nov. 15, 2018, 8 pages.
Translated International Preliminary Report on Patentability for International (PCT) Patent Application No. PCT/EP2016/060092, dated Nov. 15, 2018, 9 pages.
U.S. Appl. No. 16/178,859, filed Nov. 2, 2018, Juettner et al.
U.S. Appl. No. 16/178,909, filed Nov. 2, 2018, Blumhardt et al.
U.S. Appl. No. 16/178,933, filed Nov. 2, 2018, Wurm et al.
International Search Report for International (PCT) Patent Application No. PCT/EP2016/060060, dated Jan. 10, 2017, 2 pages.
International Search Report for International (PCT) Patent Application No. PCT/EP2017/059347, dated Jul. 25, 2017, 2 pages.
International Search Report for International (PCT) Patent Application No. PCT/EP2016/060077, dated Jan. 13, 2017, 2 pages.
International Search Report for International (PCT) Patent Application No. PCT/EP2016/060092, dated Jan. 17, 2017, 2 pages.

* cited by examiner

FLOOR TREATMENT SYSTEM

CROSS-REFERENCE TO RELATED APPLICATIONS

This application is a continuation application under 35 U.S.C. 111(a) of international application number PCT/EP2016/060060 filed on May 4, 2016, the entire disclosure of which is hereby incorporated by reference.

FIELD OF THE INVENTION

The present invention relates to a floor treatment system, comprising a mobile floor treatment apparatus and a docking station therefor, wherein the floor treatment apparatus has at least one liquid container with a container wall and a container interior, as well as at least one liquid conduit for providing a liquid for the container interior, wherein the docking station comprises a supply conduit which, in a docked position of the floor treatment apparatus on the docking station, is in fluidic connection with the at least one liquid conduit.

BACKGROUND OF THE INVENTION

The floor treatment system is for example a floor cleaning system, wherein the floor treatment apparatus takes the form of a floor cleaning apparatus. This may have at least one cleaning unit for cleaning the floor surface, to which a cleaning liquid (usually water) may be applied from the at least one liquid container for enhancing the cleaning action.

However, also conceivable are floor treatment apparatus and systems in which a liquid can be used that are configured in other ways. Examples that may be mentioned here are in particular floor polishing systems, wherein the liquid may be a polishing agent.

The at least one liquid container may therefore be in particular a reservoir for the liquid. As the level of the liquid in the liquid container falls, the floor treatment apparatus may be transferred to the docked position on the docking station. In the docked position, liquid may be provided to the at least one liquid container through the at least one liquid conduit. For example, a reservoir may be filled.

An object underlying the present invention is to construct a floor treatment system of the type mentioned in the introduction that has greater operational safety.

SUMMARY OF THE INVENTION

In an aspect of the invention, a floor treatment system comprises a mobile floor treatment apparatus and a docking station therefor, wherein the floor treatment apparatus has at least one liquid container with a container wall and a container interior, as well as at least one liquid conduit for providing a liquid for the container interior. The docking station comprises a supply conduit which, in a docked position of the floor treatment apparatus on the docking station, is in fluidic connection with the at least one liquid conduit. The floor treatment system comprises an opening device by way of which a wall portion of the container wall is movable, for clearing at least one container opening of the at least one liquid container, into an open position. In the docked position of the floor treatment apparatus the liquid can exit from the container interior through the container opening.

BRIEF DESCRIPTION OF THE DRAWINGS

The foregoing summary and the following description may be better understood in conjunction with the drawing figures, of which.

DETAILED DESCRIPTION OF PREFERRED EMBODIMENTS OF THE INVENTION

Figure 1:
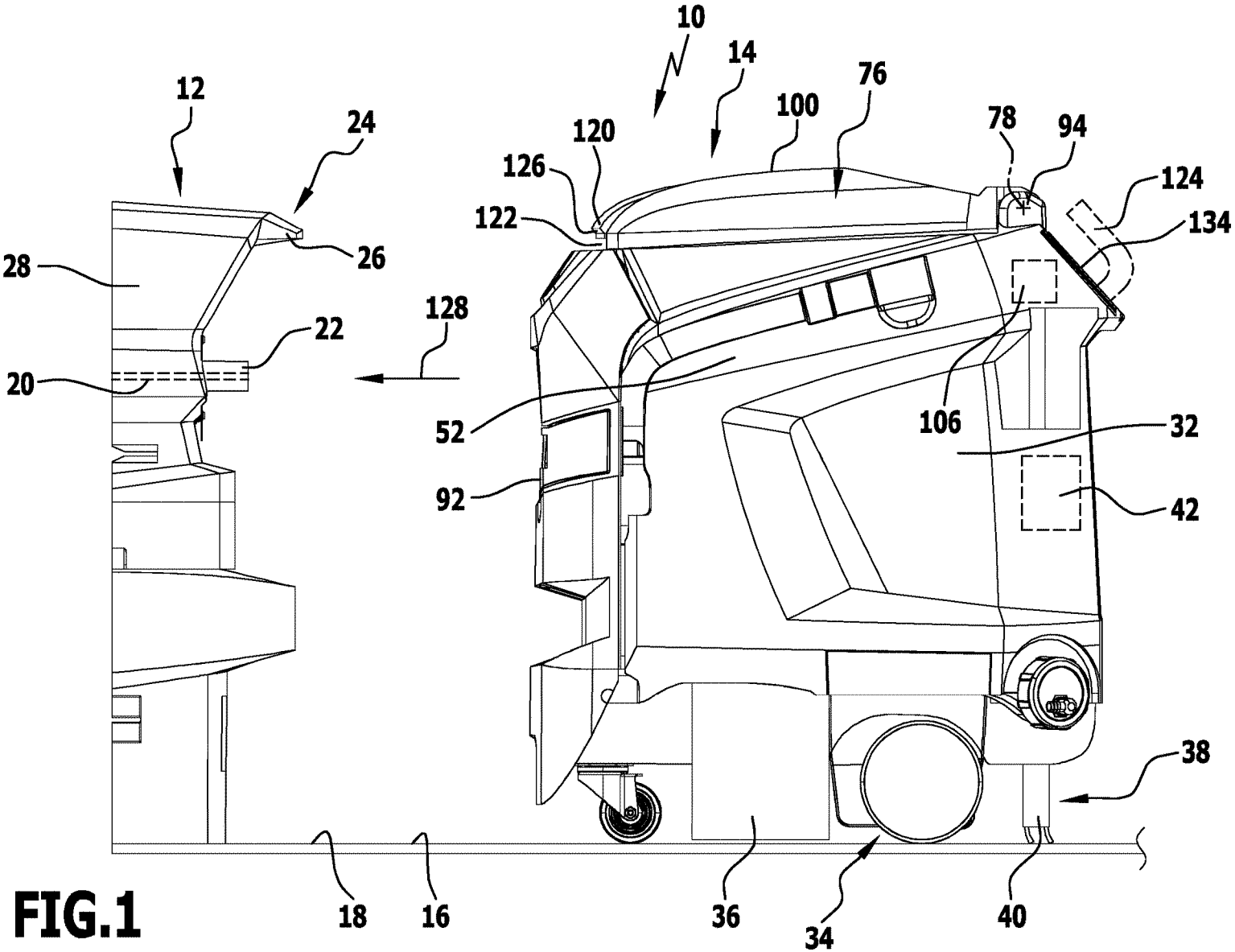
FIG. 1 shows a side view of a floor treatment system in accordance with the invention, having a docking station and a floor treatment apparatus adopting a non-docked position.

Although the invention is illustrated and described herein with reference to specific embodiments, the invention is not intended to be limited to the details shown. Rather, various modifications may be made in the details within the scope and range of equivalents of the claims and without departing from the invention.

The present invention relates to a floor treatment system, comprising a mobile floor treatment apparatus and a docking station therefor, wherein the floor treatment apparatus has at least one liquid container with a container wall and a container interior, as well as at least one liquid conduit for providing a liquid for the container interior, wherein the docking station comprises a supply conduit which, in a docked position of the floor treatment apparatus on the docking station, is in fluidic connection with the at least one liquid conduit. The floor treatment system comprises an opening device by way of which a wall portion of the container wall is movable, for clearing at least one container opening of the at least one liquid container, into an open position, so as to allow the liquid to exit from the container interior through the container opening in the docked position of the floor treatment apparatus.

In the floor treatment system in accordance with the invention, it is provided for a wall portion of the container wall to be able to adopt an open position when the floor treatment apparatus adopts the docked position. In the open position, at least one container opening of the liquid container is clear. This provides the possibility for example of venting the container interior when the liquid is applied. If the level of liquid in the container interior rises too much, it may further be provided for liquid to exit from the container interior through the container opening. In this way, the pressure in the container interior may be limited, and a backlog of liquid and backflow of liquid through the at least one liquid conduit may be prevented. The supply conduit of the docking station may be protected from ingress of germs or particles that are possibly present in the liquid container and liquid therein. This is particularly important if the docking station is connected to a liquid mains supply network by the supply conduit. As a result, the floor treatment system in accordance with the invention has greater operational safety than generic floor treatment systems.

In relation to the at least one liquid container, the wall portion may adopt a closed position in which the at least one container opening is preferably covered over and closed off.

In an advantageous embodiment of the floor treatment system, the floor treatment apparatus is advantageously self-propelling and self-steering. By means of the the floor treatment apparatus being configured as a robot, autonomous processing and in particular cleaning of the floor surface can be performed. The floor treatment apparatus may visit the docking station automatically, in particular for filling a reservoir with the liquid.

As an alternative or in addition, it may be provided for the floor treatment apparatus to be guided manually. A manually guided floor treatment apparatus may be a ride-on apparatus or a walk-behind apparatus. An operator may transfer the floor treatment apparatus to the docked position on the docking station in particular for filling the liquid container. Optionally, the floor treatment apparatus may be provided with a drive for a travelling gear.

Depending on the mode of operation, it may be provided for the floor treatment apparatus to be operated in self-propelling and self-steering manner or manually.

In an advantageous embodiment of the floor treatment system, the floor treatment apparatus is preferably a floor cleaning apparatus and has at least one cleaning unit for cleaning a floor surface. For example, the floor cleaning apparatus is a scrubber/vacuum cleaner, and the cleaning unit has at least one roller-shaped or plate-shaped cleaning tool that is drivable in rotation. A dirt receiving apparatus may be provided in order to transfer a mixture of cleaning liquid and dirt—the dirty liquid—to a dirty liquid container of the floor cleaning apparatus.

Advantageously, the at least one container opening is an overflow opening. If the level of liquid rises as far as the rim of the at least one container opening, the liquid can exit from the container interior by overflowing.

It is advantageous if a rim of the at least one container opening runs at least in certain portions along an external contour of the floor treatment apparatus, formed by a housing of the floor treatment apparatus, and if the liquid can flow out at the outside of the housing. Exiting liquid can flow down the outside of the housing, and liquid can be prevented from flowing out into the inside of the floor treatment apparatus. This enables any dirtying or damage by outflowing liquid to be avoided.

In particular, a portion of the rim that is lowest is advantageously arranged on the external contour of the floor treatment apparatus.

Preferably, the wall portion is transferable into the open position by the opening device, by moving the floor treatment apparatus from a non-docked position into the docked position. As the floor treatment apparatus is moved to the docking station for adopting the docked position, the wall portion may be transferred into the open position by the opening device, automatically and preferably without a drive. This ensures that the at least one container opening is already clear when the floor treatment apparatus is docked to the docking station.

The opening device may take different forms. For example, a mechanical, electrical, hydraulic, pneumatic and/or magnetic opening device is provided. The opening device may take the form of an active component and comprise at least one drive or actuator in order to move the wall portion. The drive or actuator may act directly or indirectly on the wall portion. A restoring device may be provided to transfer the wall portion from the open position back into a closed position. The adoption of the docked position on the docking station may be detected by at least one sensor device.

The opening device may be arranged on or comprised by the floor treatment apparatus or the docking station. Also conceivable is an opening device the components of which are arranged on or comprised by both the docking station and the floor treatment apparatus.

In an advantageous embodiment of the floor treatment system, the opening device comprises an abutment or slide element on the station and a contact element on the wall portion, wherein the contact element couples to the abutment or slide element when the floor treatment apparatus is docked to the station. In this way, the wall portion may be transferred into the open position, without a drive, in the event of movement from a non-docked position into the docked position, as described above. This already ensures at the time of docking that the at least one container opening is clear. A slide element may have a slide surface that is oriented at an angle to a direction in which the floor treatment apparatus is docked to the docking station.

Preferably, the slide element takes the form of a wedge shape. For example, the slide element may engage in an intermediate space between the wall portion and a housing portion of the floor treatment apparatus. On making contact with the slide element, the contact element may be acted upon by a force that opens the wall portion.

As an alternative or in addition it is advantageous if the slide element engages below the wall portion for moving it into or keeping it in the open position. A configuration of this kind is particularly advantageous if the wall portion is formed or comprised by a cover wall and in particular a cover of the at least one liquid container.

Advantageously, in the docked position of the floor treatment apparatus the wall portion is kept in the open position by the opening device.

Advantageously, in the docked position of the floor treatment apparatus the wall portion is still kept in the open position if a fluidic connection by the supply conduit and the at least one liquid conduit is prevented by at least one valve of the floor treatment system and the liquid is not applied to the at least one liquid container. Even if the floor treatment apparatus has been docked to the docking station but no liquid for the at least one liquid container is provided by way of the at least one liquid conduit, the wall portion can adopt the open position for clearing the at least one container opening. Venting of the container interior and exit of liquid continues to be possible in order to enhance the operational safety of the floor treatment system.

Preferably, at least one valve is positioned in the at least one liquid conduit and/or in the supply conduit, wherein the at least one valve is actuatable for clearing and/or blocking the at least one liquid conduit and/or the supply conduit.

The at least one valve is preferably clearable or actuatable by a control device of the floor treatment system. The control device may be arranged in the floor treatment apparatus or in the docking station.

It may be provided for the at least one valve to be actuatable for clearing by moving the floor treatment apparatus into the docked position. Conversely, it may be provided for the at least one valve to be actuatable for blocking by moving the floor treatment apparatus out of the docked position into a non-docked position.

The container wall may comprise a cover wall that comprises or forms the wall portion.

In an advantageous embodiment, the floor treatment apparatus has a cover of the at least one liquid container that comprises or forms the wall portion. For this reason, the cover may, as a whole or in part, be a portion of the container wall. The above-mentioned cover wall may be formed by the cover.

It is favorable if the cover is raisable away from a rim of the at least one container opening by the opening device, making it possible to clear the container opening. Correspondingly, it is advantageous if, in a closed position, the cover abuts against the rim of the at least one container opening, at least in certain regions, and covers over the container interior.

The wall portion, in particular the cover, may be mounted pivotally and/or displaceably for being pivoted open or slid open by the opening device. Preferably, the wall portion is mounted on a housing of the floor treatment apparatus.

In an advantageous embodiment, the wall portion is formed or comprised by a cover that can make contact, by a contact element, with a slide element of the opening device when the floor treatment apparatus rolls into the docked position. By sliding at the docking station, the cover may be pivoted and hence the at least one container opening cleared.

It is favorable if the wall portion, in particular the cover, is transferable under the effect of gravity from the open position into a closed position in which the at least one container opening is covered over. This gives the floor treatment system a simple structural form. If the wall portion is not kept in the open position by the opening device, it returns to the closed position automatically, for example when the floor treatment apparatus is undocked from the docking station.

As an alternative or in addition, it may be provided for the wall portion to be transferable from the open position into a closed position using a restoring device.

In a structurally simple embodiment of the floor treatment system, it has proved favorable if the at least one liquid conduit is fixed to the wall portion.

For example, it is provided for the at least one liquid conduit to run, at least in certain portions, through the wall portion or to be formed thereby. The wall portion, for example the cover, forms for example a hollow body in which the at least one liquid conduit runs in certain portions.

It is advantageous if the at least one liquid conduit has at least one outlet opening for liquid, and if, in the open position of the wall portion, the at least one outlet opening is positioned above a rim of the at least one container opening, in relation to a vertical direction. In this way, in the open position of the wall portion, the at least one outlet opening may be at a spacing from the rim and from the at least one container opening. If the level of the liquid in the container interior rises as far as the rim, this ensures that the liquid does not reach the at least one outlet opening. This enhances the operational safety of the floor treatment apparatus, since it is not possible for any particles or germs to reach the at least one liquid conduit and, in the worst case, result in contamination of the supply conduit in the docking station.

Indications of position and orientation such as "above", "below" or similar are to be understood in relation to a position of use of the floor treatment system on a set-down surface. The at least one outlet opening is thus positioned, in the vertical direction starting from the set-down surface, above the rim of the at least one container opening but not necessarily directly above the rim albeit above the container opening.

The at least one outlet opening is preferably positioned, in relation to a vertical direction, above a lowest position of the rim of the at least one container opening when the wall portion adopts the open position.

In an advantageous embodiment of the floor treatment system, there is provided, as the liquid container, a reservoir for a consumable liquid, and there is provided, as the liquid conduit, a filling conduit for filling the reservoir with the consumable liquid. In the case of a floor treatment system, the consumable liquid may be for example a cleaning liquid, in particular water or a chemical cleaning agent. The cleaning liquid is applicable to the floor surface, which may be cleaned using at least one cleaning unit. If the level of the consumable liquid exceeds a threshold level on filling, the consumable liquid may exit from the container interior through the container opening.

As an alternative or in addition, in an advantageous embodiment of the floor treatment system there may be provided a dirty liquid container as the liquid container for receiving a dirty liquid, and a rinsing conduit as the liquid conduit for rinsing the dirty liquid container. For example, in the case of a floor treatment apparatus a dirty liquid container may be provided into which the dirty liquid is transferred after being taken up from the floor surface. By way of the rinsing conduit, the rinsing liquid may be used, for example by a rinsing device of the floor treatment apparatus, for rinsing the dirty liquid container. It may for example happen that an outlet or draining opening of the dirty liquid container is closed or blocked, with the result that when rinsing liquid is applied to the container interior the level thereof in the dirty liquid container rises. The dirty liquid can exit from the container interior through the at least one container opening.

The explanations above show that the floor treatment apparatus may comprise more than one liquid container.

In an advantageous embodiment, it is provided for the at least one liquid conduit to branch at a switchable valve into a first liquid conduit portion and a second liquid conduit portion through which liquid is providable to a respective liquid container. The valve may be controlled for example by the above-mentioned control device of the floor treatment system. In particular, a reservoir may selectively be filled with a consumable liquid or a dirty liquid container be rinsed with a rinsing liquid.

As an alternative, it may be provided for the at least one liquid conduit to branch into two liquid conduit portions into each of which a valve is connected.

Further, two separate liquid conduits may be provided, for applying liquid to a respective liquid container.

Preferably in the open position the wall portion clears the respective container opening of the liquid containers. A wall portion, in particular formed or comprised by a cover, may be provided as a constituent part of a respective container wall for more than one liquid container. By transferring only one wall portion, container openings of more than one liquid container may be cleared.

The container openings are preferably positioned laterally next to one another, wherein in a closed position the wall portion abuts against a rim that encloses both container openings. In a closed position, the wall portion, in particular the cover, may cover over both container openings.

It may be provided for the container openings of two liquid containers to have a common rim portion. This rim portion may be the lowest rim portion of a rim of at least one container opening. This provides the possibility for example that liquid from a first container interior can exit, and in particular can overflow, over the lowest rim portion into a further container interior.

The floor treatment apparatus may have at least one floating body that is positioned in the container interior of a liquid container and is coupled to a valve connected into the at least one liquid conduit, in order to close this valve if there is a predeterminable threshold level of liquid in the liquid container. This enables the operational safety to be further enhanced. Using the floating body, the valve may be closed and a further application of the liquid to the container interior prevented.

Advantageously, the threshold level lies below a rim of the container opening. This for example makes it possible to ensure that liquid only exits and in particular overflows over the at least one container opening if there is a fault in the floating body/valve function.

It is favorable if the floor treatment apparatus comprises a supply conduit having a connection element arranged thereon, wherein the supply conduit opens into the at least one liquid conduit, and an outside mains supply conduit is connectable to the connection element manually for providing liquid for the at least one liquid container. As a result, the floor treatment system is usable with more versatility. An operator can connect a separate, outside mains supply conduit to the additional connection element. This makes it possible to apply liquid to the liquid container independently of the docking station. For example, the reservoir may be filled and/or the dirty liquid container rinsed. The supply conduit and the connection element are preferably arranged on the wall portion and in particular on the cover.

FIG. 1 shows a preferred embodiment of a floor treatment system in accordance with the invention that bears the reference numeral 10 and is designated the system 10 below, for the sake of simplicity. The system 10 comprises a docking station 12 and a mobile floor treatment apparatus 14, designated the apparatus 14 below, for the sake of simplicity. The system 10 is positioned in a position of use on a set-down surface 16, which at the same time forms a floor surface 18 to be cleaned.

The docking station 12 comprises a supply conduit 20, which is connected to a mains supply network in a manner not illustrated. This is in particular a mains water supply network in order to bring water to the supply conduit 20. As explained below, water is both a reserve liquid and a rinsing liquid for the apparatus 14. On the outgoing side, a connection element 22 is arranged on the supply conduit 20.

Further, the docking station 12 comprises an opening device 24. As explained below, the opening device 24 serves to transfer a cover of the apparatus 14 into an open position.

The opening device 24 has a slide element 26 that is arranged for example on or comprised by a housing 28 of the docking station 12. The slide element 26 is formed by a projection formed on the upper side of the housing 28. The slide element 26 takes the form of a wedge shape and comprises a slide surface 30. In the present case, the slide surface 30 is oriented at an angle to a plane defined by the set-down surface 16. If the set-down surface 16 is assumed to be horizontal, this plane is a horizontal plane, so the slide surface 30 is oriented at an angle to the horizontal.

Indications of position and orientation such as "above", "below" or similar are to be understood in relation to the position of use of the system 10 on the set-down surface 16.

The apparatus 14 takes the form of a floor cleaning apparatus and comprises a housing 32, on the underside thereof there is arranged a travelling gear 34 for rolling on the floor surface 18. Further, a cleaning unit 36 is arranged on the housing 32 in order to clean the floor surface 18.

The apparatus 14 is a scrubber/vacuum cleaner, so the cleaning unit 36 has at least one brush-shaped or plate-shaped cleaning tool (not shown in the drawing) that is drivable in rotation. A further cleaning unit is provided on the apparatus 14 in the form of a dirt receiving device 38 (not illustrated in FIG. 3). The dirt receiving device 38 has a suction bar 40, illustrated in FIGS. 1 and 2, and a suction unit 42 for applying negative pressure to the suction bar 40.

The apparatus 14 comprises a first liquid container 44, which is a reservoir 46 for a reserve and in particular cleaning liquid, specifically water. Further, the apparatus 14 comprises a second liquid container 48 for receiving dirty liquid, which may be rinsed by a rinsing liquid, in particular water. The second liquid container 48 is thus a dirty liquid container 50.

The housing 32 of the apparatus 14 comprises a so-called container-in-container concept, in which the dirty liquid container 50 is enclosed by the reservoir 46 surrounding it. Accordingly, the housing 32 takes a double-walled form with an outer wall 52 and an inner wall 54.

The reservoir 46 is delimited by a container wall 56 that comprises among other things the outer wall 52, the inner wall 54 and a base wall (not shown in the drawing). The container wall 56 delimits a container interior 58. Provided at the upper side of the reservoir 46 is a container opening 60 that has a rim 62. The rim 62 comprises a rim portion 64 along the external contour of the housing 32 and a rim portion 66 remote from the external contour of the housing 32.

The dirty liquid container 50 comprises a container wall 68 that comprises the inner wall 54 and a base wall (not shown in the drawing). The container wall 68 encloses a container interior 70. At the upper side, the dirty liquid container 50 has a container opening 72 that is enclosed by a rim 74. For the most part, the rim 74 runs along the external contour of the housing 32. A portion of the rim 74 is the rim portion 66 of the rim 62. As a result, the container opening 60 and the container opening 72 are separated from one another by the rim portion 66.

When the apparatus 14 is in operation, the cleaning liquid in the reservoir 46 may be applied to the floor surface 18, optionally and preferably mixed with a chemical cleaning agent. Dirt can be detached from the floor surface 18 using the cleaning unit 36. The dirty liquid can be taken up from the floor surface 18 by way of the dirt receiving apparatus 38 and deposited in the dirty liquid container 50.

As a constituent part of the housing 32, the apparatus 14 has a covering for the liquid containers 44, 48. The covering takes the form of the cover 76. In the present case, the cover 76 is held on the rest of the housing 32 such that it is pivotal about a pivot axis 78. The cover 76 can be flipped open and closed by being pivoted.

In the present case, the cover 76 forms a cover wall for both the reservoir 46 and the dirty liquid container 50. Accordingly, the cover 76 forms a constituent part of the container wall 56 of the reservoir 46, in the form of a wall portion 80. Further, the cover 76 forms a constituent part of the container wall 68 of the dirty liquid container 50, in the form of a wall portion 82.

At an underside the cover 76 has a peripheral rim 86. The rim 86 takes a form largely corresponding with the rim 74 of the container opening 72.

When the cover 72 is in a closed position, the rim 86 abuts against, and in particular lies on, the rim 74 and the rim portion 64 (FIG. 1). The cover 76 covers over the container opening 60, as a wall portion 80, and the container opening 72, as a wall portion 82. Both the reservoir 46 and the dirty liquid container 50 are closed.

Figure 2:
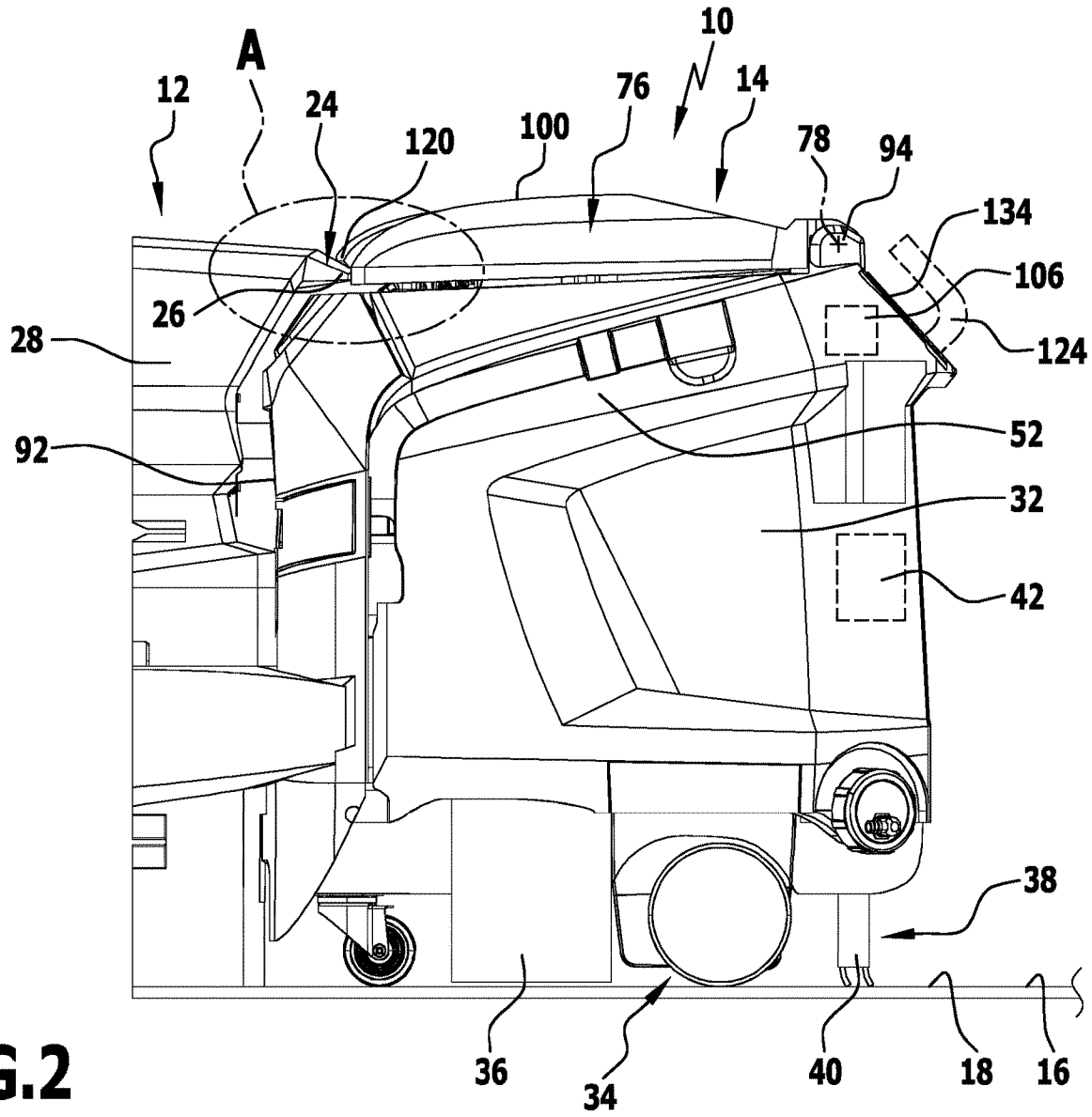
FIG. 2 shows the floor treatment system from FIG. 1, wherein the floor treatment apparatus adopts a docked position.
Figure 3:
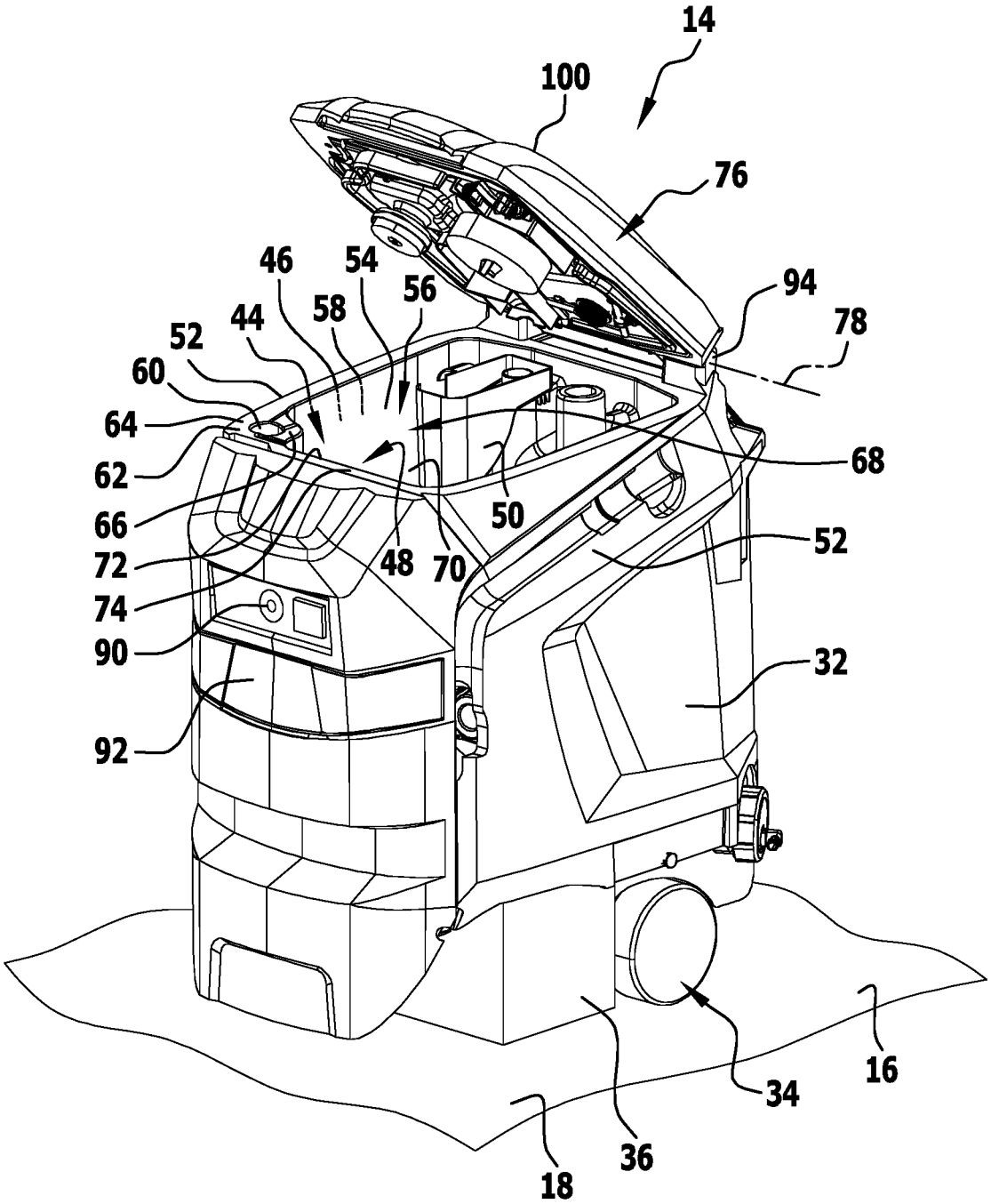
FIG. 3 shows a perspective (partial) illustration of the floor treatment apparatus from FIG. 1, having a cover adopting an open position.
Figure 4:
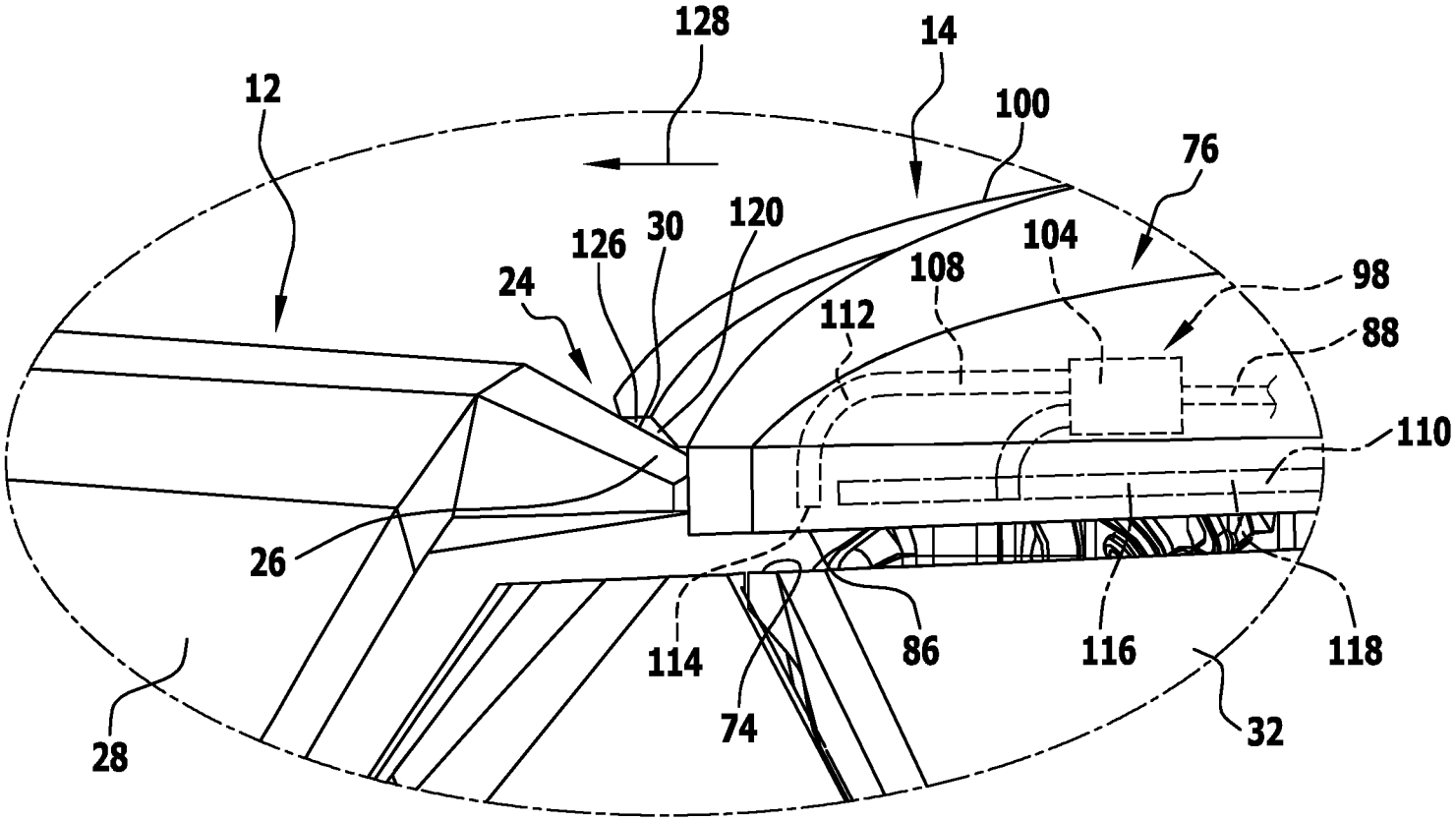
FIG. 4 shows a partly schematic illustration, on a larger scale, of detail A in FIG. 2.

By being pivoted about the pivot axis 78, the cover 76 can be transferred into an open position (FIGS. 2 and 4, and FIG. 3, with different positions of opening). In the open position, the rim 86 is raised away from the rim 74 and the rim portion 64, and the container openings 60 and 72 are cleared. This is particularly clearly visible in FIG. 3, but the container openings 60 and 72 are still cleared even with a smaller pivot angle of the cover 76 in the position of opening of the cover 76 that is illustrated in FIGS. 2 and 4.

The apparatus 14 comprises a liquid conduit 88 having a connection element 90 arranged on the ingoing side. The connection element 90 is arranged on a front side 92 of the apparatus 14, and the liquid conduit 88 extends through the housing 32 by way of a conduit portion (not illustrated in the drawing) as far as a joint 94, defining the pivot axis 78, for pivotally mounting the cover 76. The liquid conduit 88 is guided through the joint 94.

The term "front side" relates to a direction of longitudinal or principal movement of the apparatus 14. In the docked position of the apparatus 14, the front side 92 faces an end side of the docking station 12.

The cover 76 forms a hollow body 96 having a receiving space 98 between an outer wall 100 on the upper side of the apparatus 14 and an inner wall 102.

Figure 5:
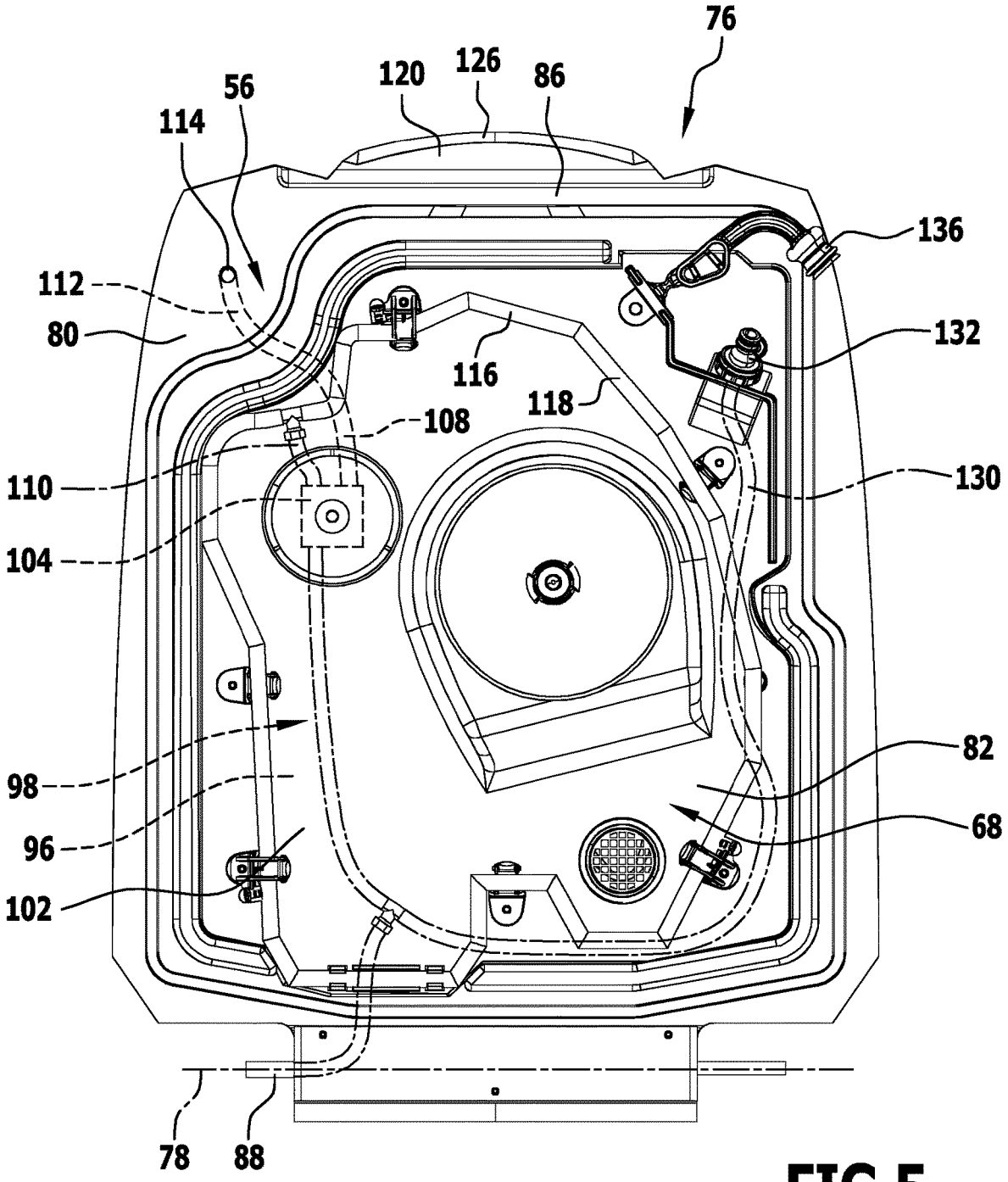
FIG. 5 shows a partly schematic view from below of the cover of the floor treatment apparatus from FIG. 1.

As is clear in particular from FIGS. 4 and 5, the liquid conduit 88 is received in the receiving space 98, downstream of the joint 94. The receiving space 98 further receives a controllable valve 104 that is actuatable by a control device 106 of the apparatus 14 (FIGS. 1 and 2). At the valve 104, the liquid conduit 88 branches into a first liquid conduit portion 108 and a second liquid conduit portion 110. Controlled by the control device 106, the valve 104 can be switched such that liquid is optionally supplied to one or both of the liquid conduit portions 108, 110. The valve 104 may form two individual valves.

A filling conduit 112 for filling the reservoir 46 is formed by way of the liquid conduit portion 108, and has an outlet opening 114 on the inner wall 102 (FIGS. 4 and 5).

A rinsing conduit 116 for rinsing the dirty liquid container 50 is formed by way of the liquid conduit portion 110. The rinsing conduit 116 comprises a ring conduit 118 having a plurality of outlet openings (not shown) for the rinsing liquid. On the underside, the rinsing conduit 116 is fixed to the inner wall 102 (FIG. 5).

The cover 76 has a projection 120 in the region of the front side 92. Formed between the projection 120 and the housing 32, in particular at the rim 74, is an intermediate space 122. The intermediate space 122 is still present when the cover 76 adopts the closed position.

The apparatus 14 may be a self-propelling and self-steering floor treatment apparatus (a floor cleaning robot) by which the floor surface 18 may be cleaned autonomously. The control device 106 can control the movements of the apparatus 14, by control of a drive for the travelling gear 34 and also the cleaning units.

As an alternative or in addition, it may be provided for the apparatus 14 to be guided manually, and to be guided over the floor surface 18 by an operator. A drive for the travelling gear 34 may be provided. The operator may operate the apparatus 14 by way of a handle 124, which is illustrated schematically in the drawing and comprises in particular a device to be held.

For filling the reservoir 46 and rinsing the dirty liquid container 50, the apparatus 14 may be docked to the docking station 12. During this, the apparatus 14 is moved, automatically or guided by the operator, from a non-docked position (FIG. 1) to a docked position (FIG. 2). In the docked position, in particular the connection elements 22 and 90 are coupled to one another to form a fluidic connection from the supply conduit 20 to the liquid conduit 88.

During docking and on adopting the docked position, the opening device 24 is active so as to transfer the cover 76, and hence the wall portions 80, 82 of the container walls 56 and 68 respectively, from the closed position into an open position and keeping them there. Here, the slide element 26 engages in the intermediate space 122 during docking (and also in the docked position). A contact element 126, which is formed by the projection 120, makes contact with the slide surface 30 of the slide element 26. As the apparatus 14 is docked in a docking direction 128, in the present case parallel with the set-down surface 16 and hence horizontal, the contact element 126 slides over the slide element 26. An opening force is applied to the cover 76 and hence the wall portions 80, 82 for pivoting them about the pivot axis 78. The rim 86 is raised away from the rim 74 and the rim portion 64, and the container openings 60 and 72 are cleared. The wall portions 80, 82 adopt an open position.

In the open position of the wall portions 80, 82, the outlet opening 114 is arranged at a spacing from the container opening 60 (FIG. 4). Accordingly, the outlet openings of the rinsing conduit 116 are arranged at a spacing from the container opening 72. This respectively means in particular that the outlet opening 114 and the outlet openings of the rinsing conduit 116 are at a respective spacing from the rim 62 and 74 respectively, and hence from a respective liquid level that can reach the rims 62 and 74.

The system 10 in accordance with the invention has enhanced operational safety.

When the apparatus 14 adopts the docked position, with the valve 104 in the appropriate switching position it is possible in particular for the reservoir 46 to be filled with the reserve liquid. There is a fluidic connection through the supply conduit 20 and the liquid conduit 88, as a filling conduit 112. The outlet opening 114 is at a spacing in relation to the rim 62, and the reservoir 46 is filled over a free path passing through the air and also through the container opening 60.

The container opening 60 that is clear in the open position of the wall portion 80 makes it possible to vent the reservoir 46 during filling, for limiting pressure. This limits the pressure in the reservoir 46, which is protected for example from bursting. A backlog of liquid to the supply conduit 20 is avoided. The liquid level can rise until the reserve liquid exits from the container interior 58 at the rim 62. Here, the outlet opening 114 is at a spacing from the maximum liquid level. This avoids a possible risk of contamination of the liquid conduit 88 and the supply conduit 20 by particles and/or germs in the liquid in the reservoir 46.

The container opening 60 is an overflow opening. The liquid can overflow over the rim portion 66, which is lower down than the rim portion 64, wherein overflowing reserve liquid is collected in the container interior 70 of the dirty liquid container 50. This prevents overflowing reserve liquid from reaching the interior of the housing 32 and making it dirty or damaging it.

The valve 104 may further be switched such that the dirty liquid container 50 is rinsed with rinsing liquid. Preferably, dirty liquid received in the container interior 70 is removed prior to rinsing through an outlet or draining opening (not illustrated in the drawing), for example being drained by way of the dirty liquid to the docking station 12.

During rinsing of the dirty liquid container 50, the rinsing liquid is applied to the container interior 70. If the outlet or draining opening is closed or blocked, the liquid level in the container interior 70 can rise. This liquid level can also rise as a result of overflowing reserve liquid, as mentioned, from the reservoir 46.

In the open position of the wall portion 82, the container opening 72 is cleared for venting, in order to prevent a rise in pressure in the container interior 70, a backlog of liquid to the supply conduit 20 and bursting of the dirty liquid container 50.

The container opening 72 is likewise an overflow opening. If the liquid level in the container interior 70 reaches the rim 74, the liquid can exit from the container interior 70 and in particular overflow. It is advantageous that the liquid can flow down the external contour of the housing 32 and so does not reach the interior of the housing 32.

In the open position of the wall portion 82, the rinsing conduit 116 is arranged with the outlet openings at a spacing from the rim 74. This makes it possible to avoid contact between the rinsing conduit 116 and liquid contaminated by any particles and/or germs in the container interior 70. In this case too, contamination of the supply conduit 20 is avoided.

The cover 76 and hence the wall portions 80, 82 may be transferred from the open position back into the closed position automatically. When the apparatus 14 is undocked from the docking station 12, the cover 76 pivots again under the effect of gravity about the pivot axis 78 until the rim 86 lies on the rim 74 and the rim portion 64, and closes off both liquid containers 44, 48.

As can be seen in particular from FIG. 5, at the cover 76 the apparatus 14 comprises a supply conduit 130. The supply conduit 130 opens into the liquid conduit 88, in the receiving space 98 and upstream of the valve 104. Arranged on the end of the supply conduit 130 is a connection element 132 that, in the present case, takes the form of a hose nipple.

An outside mains supply conduit (not shown in the drawing) may be connected to the connection element 132 by an operator in order to apply liquid, in particular water, to the supply conduit 130. The liquid flows into the valve 104 and from there optionally into one of the liquid conduit portions 108, 110 for filling the reservoir 46 and/or rinsing the dirty liquid container 50. It is conceivable for the liquid conduit portion 108, 110 which is cleared or blocked to be predeterminable by the operator, by way of an operating device 134 of the apparatus 14.

A self-locking valve that is arranged in the connection element 90 ensures that if the outside mains supply conduit is connected when the apparatus 14 is undocked, no liquid exits from the liquid conduit 88.

In addition to the possibility of filling or rinsing the reservoir 46 and the dirty liquid container 50 using the arrangements of the docking station 12, if the outside mains supply conduit is connected to the supply conduit 130 they can be used to perform a filling or rinsing procedure of this kind.

It is likewise possible to provide a self-locking valve and/or a closing-off element 136 at the connection element 132, such that when fluid is applied to the liquid conduit 88 through the docking station 12 no liquid exits through the supply conduit 130. FIG. 5 shows the closing-off element 136 in a condition detached from the connection element 132.

The arrangement of the connection element 132 and the course of the supply conduit 130 may also be different. For example, the connection element 132 is positioned such that it is accessible to a person operating the system without opening the cover 76. However, it is advantageous to integrate the supply conduit 130 at least partly in the cover 76 and to arrange the connection element 132 on the cover 76 such that the cover 76 has to be opened in order to connect the supply conduit and thus venting is ensured.

REFERENCE NUMERALS

10 Floor treatment system
12 Docking station
14 Apparatus
16 Set-down surface
18 Floor surface
20 Supply conduit
22 Connection element
24 Opening device
26 Slide element
28 Housing
30 Slide surface
32 Housing
34 Travelling gear
36 Cleaning unit
38 Dirt receiving device
40 Suction bar
42 Suction unit
44 Liquid container
46 Reservoir
48 Liquid container
50 Dirty liquid container
52 Outer wall
54 Inner wall
56 Container wall
58 Container interior
60 Container opening
62 Rim
64 Rim portion
66 Rim portion
68 Container wall
70 Container interior
72 Container opening
74 Rim
76 Cover
78 Pivot axis
80 Wall portion
82 Wall portion
86 Rim
88 Liquid conduit
90 Connection element
92 Front side
94 Joint
96 Hollow body
98 Receiving space
100 Outer wall
102 Inner wall
104 Valve
106 Control device
108 Liquid conduit portion
110 Liquid conduit portion
112 Filling conduit
114 Outlet opening
116 Rinsing conduit
118 Ring conduit
120 Projection
122 Intermediate space
124 Handle
126 Contact element
128 Docking direction
130 Supply conduit
132 Connection element
134 Operating device
136 Closing-off element

What is claimed is:

1. A floor treatment system, comprising a mobile floor treatment apparatus and a docking station therefor, wherein the floor treatment apparatus has at least one liquid container with a container wall and a container interior, as well as at least one liquid conduit for providing a liquid for the container interior, wherein the docking station comprises a supply conduit which, in a docked position of the floor treatment apparatus on the docking station, is in fluidic connection with the at least one liquid conduit, wherein the floor treatment system comprises an opening device by way of which a wall portion of the container wall is movable, for clearing at least one container opening of the at least one liquid container, into an open position, so as to allow the liquid to exit from the container interior through the container opening in the docked position of the floor treatment apparatus.

2. The floor treatment system in accordance with claim 1, wherein the floor treatment apparatus is self-propelling and self-steering.

3. The floor treatment system in accordance with claim 1, wherein the floor treatment apparatus is guided manually.

4. The floor treatment system in accordance with claim 1, wherein the floor treatment apparatus is a floor cleaning apparatus and has at least one cleaning unit for cleaning a floor surface.

5. The floor treatment system in accordance with claim 1, wherein the at least one container opening is an overflow opening.

6. The floor treatment system in accordance with claim 1, wherein a rim of the at least one container opening runs at least in certain portions along an external contour of the floor treatment apparatus, formed by a housing of the floor treatment apparatus, and wherein the liquid flows out at the outside of the housing.

7. The floor treatment system in accordance with claim 1, wherein the wall portion is transferable into the open position by the opening device, by moving the floor treatment apparatus from a non-docked position into the docked position.

8. The floor treatment system in accordance with claim 1, wherein at least one of a mechanical, electrical, hydraulic, pneumatic and magnetic opening device is provided.

9. The floor treatment system in accordance with claim 1, wherein the opening device comprises an abutment or slide element on the docking station, and a contact element on the wall portion, wherein the contact element couples to the abutment or slide element when the floor treatment apparatus is docked to the docking station.

10. The floor treatment system in accordance with claim 9, wherein the slide element takes the form of a wedge shape and/or engages below the wall portion for moving it into or keeping it in the open position.

11. The floor treatment system in accordance with claim 1, wherein in the docked position of the floor treatment apparatus the wall portion is kept in the open position by the opening device.

12. The floor treatment system in accordance with claim 1, wherein at least one valve is positioned in at least one of the at least one liquid conduit and the supply conduit, and wherein the at least one valve is actuatable for clearing and actuatable for blocking at least one of the at least one liquid conduit and the supply conduit.

13. The floor treatment system in accordance with claim 12, wherein the at least one valve is clearable or actuatable by a control device of the floor treatment system.

14. The floor treatment system in accordance with claim 12, wherein the at least one valve is actuatable for clearing by moving the floor treatment apparatus into the docked position.

15. The floor treatment system in accordance with claim 1, wherein the container wall comprises a cover wall that comprises or forms the wall portion.

16. The floor treatment system in accordance with claim 1, wherein the floor treatment apparatus has a cover of the at least one liquid container which cover comprises or forms the wall portion.

17. The floor treatment system in accordance with claim 16, wherein the cover is raisable away from a rim of the at least one container opening by the opening device, and wherein, in a closed position, the cover abuts against the rim of the at least one container opening, at least in certain regions, and covers over the container interior.

18. The floor treatment system in accordance with claim 1, wherein the wall portion is mounted at least one of pivotally and displaceably for being pivoted open or slid open by the opening device.

19. The floor treatment system in accordance with claim 1, wherein the wall portion is transferable under the effect of gravity from the open position into a closed position in which the at least one container opening is covered over.

20. The floor treatment system in accordance with claim 1, wherein the wall portion is transferable from the open position into a closed position using a restoring device.

21. The floor treatment system in accordance with claim 1, wherein the at least one liquid conduit is fixed to the wall portion.

22. The floor treatment system in accordance with claim 1, wherein the at least one liquid conduit runs, at least in certain regions, through the wall portion or is formed thereby.

23. The floor treatment system in accordance with claim 1, wherein the at least one liquid conduit has at least one outlet opening for liquid, and wherein, in the open position of the wall portion, the at least one outlet opening is positioned above a rim of the at least one container opening.

24. The floor treatment system in accordance with claim 1, wherein there is provided as the liquid container a reservoir for a consumable liquid, and wherein there is provided as the liquid conduit a filling conduit for filling the reservoir with the consumable liquid.

25. The floor treatment system in accordance with claim 1, wherein there is provided as the liquid container a dirty liquid container for receiving a dirty liquid, and wherein there is provided as the liquid conduit a rinsing conduit for rinsing the dirty liquid container.

26. The floor treatment system in accordance with claim 1, wherein the floor treatment apparatus comprises more than one liquid container.

27. The floor treatment system in accordance with claim 26, wherein the at least one liquid conduit branches at a switchable valve into a first liquid conduit portion and a second liquid conduit portion through which liquid is providable to a respective liquid container.

28. The floor treatment system in accordance with claim 26, wherein in the open position the wall portion clears the respective container opening of the liquid containers.

29. The floor treatment system in accordance claim 26, wherein the container openings are positioned laterally next to one another, and wherein in a closed position the wall portion abuts against a rim that encloses both container openings.

30. The floor treatment system in accordance with claim 1, wherein the floor treatment apparatus has at least one floating body that is positioned in the container interior of a liquid container and is coupled to a valve connected into the at least one liquid conduit, in order to close this valve if there is a predeterminable threshold level of liquid in the liquid container.

31. The floor treatment system in accordance with claim 30, wherein the threshold level lies below a rim of the container opening.

32. The floor treatment system in accordance with claim 1, wherein the floor treatment apparatus comprises a supply conduit having a connection element arranged thereon, wherein the supply conduit opens into the at least one liquid conduit, and an outside mains supply conduit is connectable to the connection element manually for providing liquid for the at least one liquid container.

* * * * *